US010332341B2

(12) United States Patent
Cardno

(10) Patent No.: US 10,332,341 B2
(45) Date of Patent: Jun. 25, 2019

(54) GAMING INTELLIGENCE SYSTEM AND METHOD

(71) Applicant: New BIS Safe Luxco S.à r.l., Luxembourg (LU)

(72) Inventor: Andrew John Cardno, San Diego, CA (US)

(73) Assignee: New BIS Safe Luxco S.à r.l, Luxembourg (LU)

( * ) Notice: Subject to any disclaimer, the term of this patent is extended or adjusted under 35 U.S.C. 154(b) by 1028 days.

(21) Appl. No.: 14/038,068

(22) Filed: Sep. 26, 2013

(65) Prior Publication Data

US 2014/0171181 A1 Jun. 19, 2014

Related U.S. Application Data

(60) Provisional application No. 61/707,433, filed on Sep. 28, 2012.

(51) Int. Cl.
*G07F 17/32* (2006.01)

(52) U.S. Cl.
CPC ..... *G07F 17/323* (2013.01); *G07F 17/3232* (2013.01)

(58) Field of Classification Search
CPC .... G07F 17/32; G07F 17/3262; G07F 17/323; G07F 17/3232
USPC ..... 463/16, 20, 25
See application file for complete search history.

(56) References Cited

U.S. PATENT DOCUMENTS

2003/0078101 A1* 4/2003 Schneider ..... G07F 17/32 463/42
2003/0109307 A1* 6/2003 Boyd ..... G07F 17/32 463/41
2007/0243928 A1* 10/2007 Iddings ..... G07F 17/32 463/26

* cited by examiner

*Primary Examiner* — Omkar A Deodhar
*Assistant Examiner* — Wei Lee
(74) *Attorney, Agent, or Firm* — Merchant & Gould P.C.

(57) ABSTRACT

A Gaming Intelligence System and Method are described, the method comprising correlating player and game information from two sets of gaming information obtained from a plurality of gaming machines. The first set of information includes player information and transactional information and the second set of information includes game information and transactional information. By optimizing an allocation of transactional information using a goodness measure, correlations between player information and game information are obtained. A gaming intelligence system that determines correlations between player IDs and game IDs is also described.

41 Claims, 1 Drawing Sheet

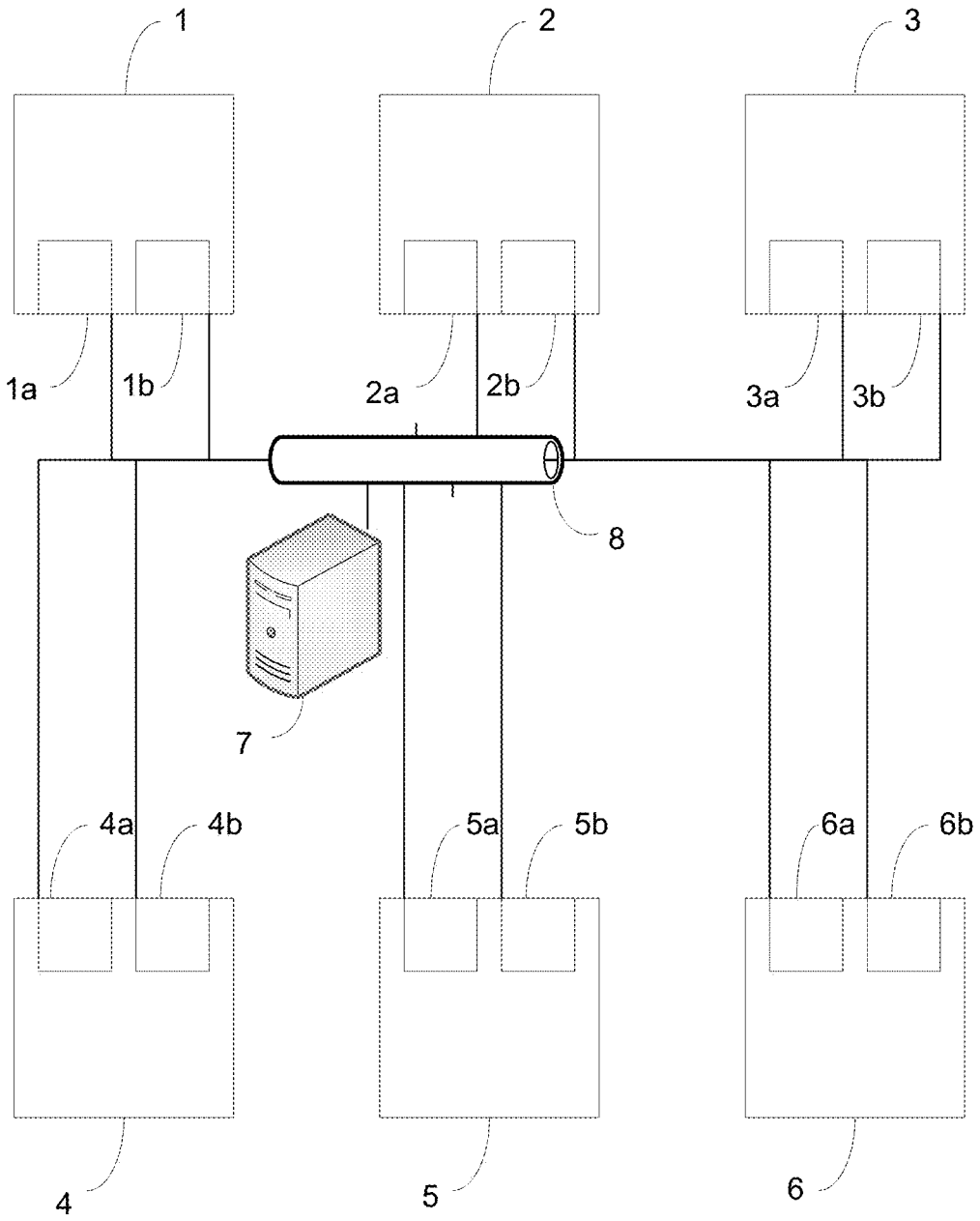
1
2
3
1a
1b
2a
2b
3a
3b
8
7
4a
4b
5a
5b
6a
6b
4
5
6

GAMING INTELLIGENCE SYSTEM AND METHOD

This application claims benefit of U.S. Provisional Ser. No. 61/707,433, filed 28 Sep. 2012 and which application is incorporated herein by reference. To the extent appropriate, a claim of priority is made to the above disclosed application.

FIELD OF THE INVENTION

This invention relates to a gaming intelligence system and method for correlating game and player information from independent information sources.

BACKGROUND OF THE INVENTION

Many conventional gaming machines have two separate systems for collecting operational data. The first collects transaction information and player information. The second collects transaction information and game information. The transactional information typically includes game plays, amounts paid in (Coin In), amounts paid out (Coin Out) and Jackpots.

To date it has not been possible to relate game information to players. This would be useful for marketing purposes and to optimize gaming operations including machine layout and gaming machine operation.

It is an object of the invention to provide a gaming intelligence system and method that provides such functionality or to at least provide the public with a useful choice.

SUMMARY OF THE INVENTION

According to one exemplary embodiment there is provided a method of correlating player and game information from two sets of gaming information obtained from a plurality of gaming machines wherein a first set of information includes player information and transactional information and a second set of information includes game information and transactional information wherein by optimizing an allocation of transactional information using a goodness measure correlations between player information and game information are obtained.

According to another exemplary embodiment there is provided a gaming intelligence system comprising:

a. a plurality of gaming machines, each machine including:
   i. a first monitoring unit that stores information relating to a player ID and transaction information; and
   ii. a second monitoring unit that stores information relating to a game ID and transaction information,
b. an evaluation system that receives information relating to player ID, game ID and transaction information from the monitoring units and determines correlations between player IDs and game IDs by correlating transaction information.

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e. they will be taken to mean an inclusion of the listed components which the use directly references, and possibly also of other non-specified components or elements.

Reference to any prior art in this specification does not constitute an admission that such prior art forms part of the common general knowledge.

BRIEF DESCRIPTION OF THE DRAWINGS

The accompanying drawings which are incorporated in and constitute part of the specification, illustrate embodiments of the invention and, together with the general description of the invention given above, and the detailed description of exemplary embodiments given below, serve to explain the principles of the invention.

FIG. 1 shows a gaming intelligence system according to one aspect of the present invention.

DETAILED DESCRIPTION OF EMBODIMENTS OF THE INVENTION

Referring to FIG. 1 there is shown a gaming intelligence system according to one embodiment. A plurality of gaming machines 1 to 6 each have a first monitoring unit 1*a* to 6*a* that monitors player IDs and transactional information relating to each player including Game plays, Coin In, Coin Out and Jackpots. Gaming machines 1 to 6 each also have a second monitoring unit 1*b* to 6*b* that monitors game IDs and transactional information relating to each game including Game plays, Coin In, Coin Out and Jackpots.

Data from the monitoring units 1*a* to 6*a* and 1*b* to 6*b* is supplied over a communications network 8 (that may be wired or wireless) to a data analysis system 7. Data analysis system 7 may determine precise or optimized correlations between players and games played. The term "correlation" in this specification refers to associations between players and games and not necessarily a statistical relationship.

EXAMPLE

The method of the invention will be illustrated by way of example. In the example the actual data is as shown in Table 1 below but this information is not available in the gaming systems to which this invention is directed.

TABLE 1

Actual data (not available)

| Machine Theme | Player | Games | CoinIn | CoinOut |
|---|---|---|---|---|
| Keno | Charles | 5 | 10 | 8 |
| Keno | Bob | 10 | 20 | 30 |
| Video Poker | Alice | 8 | 40 | 38 |
| Video Poker | Bob | 1 | 1 | 0 |
| Video Poker | Not Recorded | 6 | 12 | 14 |
| Slots | Not Recorded | 9 | 15 | 13 |

The actual data available is that from monitoring units 1*a* to 6*a* relating to player and transactional data as shown in table 2 below and that from monitoring units 1*b* to 6*b* relating to game and transactional data as shown in table 3 below.

TABLE 2

| Player Data | | | |
|---|---|---|---|
| Player | Game plays | CoinIn | CoinOut |
| Alice | 8 | 40 | 38 |
| Bob | 11 | 21 | 30 |
| Charles | 5 | 10 | 8 |

TABLE 3

| Machine Data | | | |
|---|---|---|---|
| Machine Theme | Game plays | CoinIn | CoinOut |
| Keno | 15 | 30 | 38 |
| Video Poker | 15 | 53 | 52 |
| Slots | 9 | 15 | 13 |

Tables may then be compiled providing an initial allocation of games to players for each field of transaction information. Tables 4 to 6 show such tables for Games, Coin In and Coin Out. The tables 4 to 6 include totals from tables 2 and 3 and error values for each row and column representing the difference between the totals row or column and the sum of the table values in the row or column.

The initial table values may be allocated in a number of ways including:

1. Easy allocation—according to this method as much value as possible is allocated to table cells as they are sequentially populated from one side to the other or up or down. As the name suggests this approach is simple to implement.
2. Greedy algorithm—as much value as possible is allocated to the largest values first—this approach may result in fast convergence but it may not necessarily be the best approach for optimization.
3. Random—according to this method rows or columns are selected randomly as much value as possible as possible is allocated to each selected row or column.

Error values are calculated after the tables are populated.

Table 4 has been populated using the Easy allocation method. The totals 8, 11 and 5 are obtained from the first column of table 2. The totals 15, 15 and 9 are obtained from first column of able 3. The first table cell to filled using the Easy allocation method is the Alice:Keno cell. From table 2 it is known that Alice has had 8 game plays and so these are all allocated to this cell. The next cell is the Bob:Keno cell and although Bob has had 11 game plays only 7 are available in view of the total of 15 for the row. As the total row value has been reached all remaining row values must be zero.

Populating the next row the Alice:Video Poker cell must be zero as Alice's entire column total has been used above. The Bob:Video Poker cell is populated with 4—being the remainder that Bob has available. The Charles:Video Poker cell is populated with 5 being the maximum he has available. The remaining values must all be zero as all players values have been allocated. The error values are then calculated. The same method is used to populate tables 5 and 6.

TABLE 4

| Initial Allocation - Games | | | | | |
|---|---|---|---|---|---|
| | | Player: | | | |
| Machine Theme | Totals | Alice 8 | Bob 11 | Charles 5 | Error 15 |
| Keno | 15 | 8 | 7 | 0 | 0 |
| Video Poker | 15 | 0 | 4 | 5 | 6 |
| Slots | 9 | 0 | 0 | 0 | 9 |
| Error | 0 | 0 | 0 | 0 | 0 |

TABLE 5

| Initial Allocation - Coin In | | | | | |
|---|---|---|---|---|---|
| | | Player: | | | |
| Machine Theme | Totals | Alice 40 | Bob 21 | Charles 10 | Error 27 |
| Keno | 30 | 30 | 0 | 0 | 0 |
| Video Poker | 53 | 10 | 21 | 10 | 12 |
| Slots | 15 | 0 | 0 | 0 | 15 |
| Error | 0 | 0 | 0 | 0 | 0 |

TABLE 6

| Initial Allocation - Coin Out | | | | | |
|---|---|---|---|---|---|
| | | Player: | | | |
| Machine Theme | Totals | Alice 8 | Bob 30 | Charles 38 | Error 27 |
| Keno | 38 | 8 | 30 | 0 | 0 |
| Video Poker | 52 | 0 | 0 | 38 | 14 |
| Slots | 13 | 0 | 0 | 0 | 13 |
| Error | 0 | 0 | 0 | 0 | 0 |

A first iteration is then processed. One preferred method is to identify a non zero value and consider a swap of the value or a portion of the value with another cell that is not in the same row or column. Applying a "greedy" approach the largest values may be assessed first. Alternatively using a "maximum descent" approach all possible swaps may be evaluated in each iteration. Whilst a single swap is described for each iteration swaps may affect more than a pair of cells.

In this example we swap the entries for Alice:Keno & Bob:Video Poker. This swap will move 4 in Games table 4, 21 in Coin In table 5, and 0 in Coin Out table 6. These are the minimum of the values in both selected records. Alice: Keno decreases by 4, 21, 0; Bob:Video Poker decreases by 4, 21, 0; Alice:Video Poker increases by 4, 21, 0; and Bob:Keno increases by 3, 21, 0. The values after this iteration are shown in table 7.

TABLE 7

| First iteration of table 4 after Swapping Games | | | | | |
|---|---|---|---|---|---|
| | | Player: | | | |
| Machine Theme | Totals | Alice 8 | Bob 11 | Charles 5 | Error 15 |
| Keno | 15 | 4 | 11 | 0 | 0 |
| Video Poker | 15 | 4 | 0 | 5 | 6 |
| Slots | 9 | 0 | 0 | 0 | 9 |
| Error | 0 | 0 | 0 | 0 | 0 |

TABLE 8

First iteration of table 5 after Swapping Games
Coin In

| Machine Theme | Totals | Player: Alice 40 | Bob 21 | Charles 10 | Error 27 |
|---|---|---|---|---|---|
| Keno | 30 | 9 | 21 | 0 | 0 |
| Video Poker | 53 | 31 | 0 | 10 | 12 |
| Slots | 15 | 0 | 0 | 0 | 15 |
| Error | 0 | 0 | 0 | 0 | 0 |

TABLE 9

First iteration of table 6 after Swapping Games
Coin Out

| Machine Theme | Totals | Player: Alice 8 | Bob 30 | Charles 38 | Error 27 |
|---|---|---|---|---|---|
| Keno | 38 | 8 | 30 | 0 | 0 |
| Video Poker | 52 | 0 | 0 | 38 | 14 |
| Slots | 13 | 0 | 0 | 0 | 13 |
| Error | 0 | 0 | 0 | 0 | 0 |

This swap increases sparsity by one, as the record in Bob, Video Poker is now zero.

Each swap is evaluated to see if it is beneficial or detrimental to a goodness measure. A range of possible goodness measures may be employed but a preferred goodness measure is a weighted combination of factors. One preferred goodness measure includes sparsity and Coin In: Coin Out ratios. It has been found that incentivizing sparsity in the goodness measure assists in driving rapid convergence as well as producing solutions with lower dimensionality that may be more usable.

The weightings may be dependent upon the usage of output information. Greater sparsity may be better where clear trends are desired whereas Coin In: Coin Out ratio may be emphasised where greater accuracy is desired. The weightings may also change during processing—for example emphasising sparsity at the beginning and Coin In: Coin Out ratio towards the end.

A swap satisfying the goodness measure may be retained and one that fails may be rejected and the previous tables reinstated. Processing then goes on to a further iteration (i.e. the next swaps) as outlined above.

The goodness measure may undergo annealing as iterations progress—i.e. a higher level of goodness may be required for a swap to be accepted in later stages of processing. The initial level may in fact be low enough to ensure that a wide range of possible solution paths are explored in early iteration.

In order to consider a wide range of possible solution paths a "Shotgun" approach may be employed where periodically the result at a certain stage of processing is saved and the tables are all re-initialised (Preferably using the Random population technique in paragraph 3 above). By doing this a number of times the possible solution space may be better explored. The values obtained at the end of each processing cycle may be compared to select the result best satisfying the goodness measure. This result may go through further iterations until convergence is achieved.

There is thus provided a method and system enabling the correlation of player and game information via matching of transaction information. Using sparsity as a measure of goodness emphasizes key correlations and drives solution by reducing entries and avoiding data spread.

While the present invention has been illustrated by the description of the embodiments thereof, and while the embodiments have been described in detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the applicant's general inventive concept.

The invention claimed is:

1. A method executable on an electronic computing device of correlating player and game theme transaction information from two sets of gaming transaction information obtained from a plurality of gaming machines wherein each gaming machine plays at least one of a plurality of machine themes, the method comprising the steps of:

receiving player transaction information, the player transaction information consisting of machine id, player id, coin in and coin out on a plurality of players;

receiving machine theme transaction information consisting of machine id, theme played, coin in and coin out on at least one of a plurality of machine themes, wherein the machine theme transaction information is independent of the player transaction information;

generating correlated transaction information on the machine themes played by the plurality of players using a goodness measure, by correlating the player transaction information and the independent machine theme transaction information, wherein the correlated transaction information includes machine id, player id, theme played, coin in and coin out; and using the correlated transaction information to optimize gaming operations by altering the machine layout.

2. The method as claimed in claim 1 wherein the allocation of transaction information is optimized using an iterative process.

3. The method as claimed in claim 2 wherein iteration is directed by the goodness measure.

4. The method as claimed in claim 3 wherein an attribute of the goodness measure is transaction information sparcity.

5. The method as claimed in claim 3 wherein an attribute of the goodness measure is related to one or more ratio of transaction information.

6. The method as claimed in claim 4 wherein an attribute of the goodness measure is related to one or more ratio of transaction information.

7. The method as claimed in claim 4 wherein weightings are applied to attributes.

8. The method as claimed in claim 7 wherein weightings change over iterations.

9. The method as claimed in claim 8 wherein transaction information sparcity has a higher weighting for earlier iterations than later iterations.

10. The method as claimed in claim 9 wherein the goodness measure is annealed as iterations progress.

11. The method as claimed in claim 10 wherein tables relating players to game themes are produced for one or more type of transaction information.

12. The method as claimed in claim 11 wherein tables relating players to game themes are produced for a plurality of types of transaction information.

13. The method as claimed in claim 11 wherein the fields are selected from coin in; coin out, game plays and jackpot.

14. The method as claimed in claim 11 wherein in each iteration consideration is given to exchanging table values and a measure of goodness of the tables with the exchanged values is utilizes to assess whether a change is kept or discarded.

15. The method as claimed in claim 13 wherein in each iteration consideration is given to exchanging table values and a measure of goodness of the tables with the exchanged values is utilizes to assess whether a change is kept or discarded.

16. The method as claimed in claim 14 wherein for each non-zero table value exchanges with all other table locations are considered.

17. The method as claimed in claim 14 wherein for each non-zero value exchanges with all other table locations not in the same row or column are considered.

18. The method as claimed in claim 16 wherein the largest values are considered first.

19. The method as claimed in claim 17 wherein the largest values are considered first.

20. The method as claimed in claim 11 wherein the table cells are initially populated according to rules.

21. The method as claimed in claim 11 wherein the table cells are initially populated in a pseudo random order.

22. The method as claimed in claim 11 wherein the table cells are initially populated in order along a row or column.

23. The method as claimed in claim 11 wherein the table cells are initially populated by allocating table values from the largest to the smallest.

24. The method as claimed claim 11 wherein the tables include total values for each row and column derived from the transaction information.

25. The method as claimed in claim 24 wherein the tables include error values for each row and column being the difference between the row or column total and the sum of the row or column values.

26. The method as claimed in claim 11 wherein a meta-algorithm controls one or more sub algorithm.

27. The method as claimed in claim 20 wherein a meta-algorithm controls one or more sub algorithm.

28. The method as claimed in claim 27 wherein the meta-algorithm resets the initial table values one or more times during processing.

29. The method as claimed in claim 2 wherein processing terminates after a prescribed number of iterations.

30. The method as claimed in claim 3 wherein processing terminates after a prescribed number of iterations.

31. The method as claimed in claim 20 wherein processing terminates after a prescribed number of iterations.

32. The method as claimed in claim 27 wherein processing terminates after a prescribed number of iterations.

33. The method as claimed in claim 2 wherein processing terminates when the goodness measure is within an acceptable range.

34. The method as claimed in claim 3 wherein processing terminates when the goodness measure is within an acceptable range.

35. The method as claimed in claim 20 wherein processing terminates when the goodness measure is within an acceptable range.

36. The method as claimed in claim 27 wherein processing terminates when the goodness measure is within an acceptable range.

37. The method as claimed in claim 2 wherein prior to performing any iterations table values having a high confidence level are frozen.

38. The method as claimed in claim 11 wherein table values are frozen when there is a unique relationship between table values.

39. The method as claimed in claim 20 wherein table values are frozen when there is a unique relationship between table values.

40. The method as claimed in claim 37 wherein table values are frozen when there is a unique relationship between table values.

41. A gaming intelligence system comprising:

a. a plurality of gaming machines, each machine including:

i. a first monitoring unit that stores first transaction information relating to players, the first transaction information consisting of machine id, player id, coin in and coin out on a plurality of players; and ii. a second independent monitoring unit that stores second transaction information relating to machine game themes, the second transaction information consisting of theme played, coin in and coin out, the second monitoring unit being independent of the first monitoring unit and the second monitoring unit storing no player ID information; and b. an evaluation system on an electronic computing device that receives the first transaction information and the second independent transaction information from the first and second monitoring units and determines correlations between player IDs and game theme IDs by correlating the first transaction information and the second independent transaction information to produce correlated player and game theme transaction information for each of the plurality of machines, wherein the correlated player and game theme transaction information includes machine id, player id, theme played, coin in and coin out and wherein the correlated player and game theme information is used by the gaming intelligence system in optimizing gaming operations by altering the machine layout.

* * * * *